US006016853A

United States Patent [19]

Wang

[11] Patent Number: 6,016,853

[45] Date of Patent: Jan. 25, 2000

[54] TOOTHPASTE SQUEEZER

[76] Inventor: Den-Fuw Wang, No. 306, Wen Hua Rd. Sec. 1, Pan Chiao City, Taipei Hsien, Taiwan

[21] Appl. No.: 09/219,826

[22] Filed: Dec. 23, 1998

[51] Int. Cl.[7] ..... B65B 3/00

[52] U.S. Cl. ..... 141/362; 141/357; 141/360; 222/95; 222/105; 222/207

[58] Field of Search ..... 141/351, 352, 141/360, 362, 357; 222/95, 96, 105, 207

[56] References Cited

U.S. PATENT DOCUMENTS

| | | | |
|---|---|---|---|
| 4,178,975 | 12/1979 | Crespi | 141/362 |
| 4,303,110 | 12/1981 | Chen | 141/362 |
| 5,145,095 | 9/1992 | Loudon | 141/360 |

*Primary Examiner*—J. Casimer Jacyna
*Attorney, Agent, or Firm*—Bacon & Thomas, PLLC

[57] ABSTRACT

Disclosed herein is a novel toothpaste squeezer comprising a corrugated elastic tube with its two ends connected to a delivery tube and a guide tube respectively, and a base plate composed of a sliding guide and a fender to which the delivery tube is fastened. A sealed toothpaste container is connected to the corrugated elastic tube through the guide tube. A slider is provide at the bottom of the delivery tube which is coupled with a sliding guide installed on the base plate. A toothbrush seat is located at the front end of the slider so as to move the slider and delivery tube to and fro along the sliding guide. When the toothbrush placed on the toothbrush seat moves, the slider and the delivery tube to and fro thereby squeezing and releasing the corrugated elastic tube to absorb the toothpaste from the toothpaste container to output and then interrupt outputting the toothpaste from the supply head of the delivery tube resulting in supplying a fixed quantity of toothpaste to the toothbrush without making mutual contact between the supply head and the toothbrush to prevent possible contamination. The appearance of the delivery tube is made into a pleasant looking human, bird or animal head figures.

4 Claims, 3 Drawing Sheets

TOOTHPASTE SQUEEZER

BACKGROUND OF THE INVENTION

1. Field of the invention

The present invention relates to a novel toothpaste squeezer, and more particularly, to toothpaste squeezer having a corrugated elastic tube which can control the output of toothpaste from a supply head with a fixed quantity by means of expantion and contraction action of the corrugated elastic tube.

2. Description of the Prior Art

When brushing their teeth, most of people put their toothpaste tube directly on toothbrushes and spread toothpaste uniformly on the surface of toothbrushes. As all persons in a family each of them having his/her own toothbrush commonly use a toothpaste tube, the toothpaste tube contacting all the toothbrushes in the family will inevitably become an infectious contamination source. In addition, it is hard to control a proper quantity for toothpaste to be supplied by squeezing with the user's fingers, and a commonly used toothpaste tube is subjected to too frequent open/close operation.

In order to solve such disadvantages, the inventor of the present invention, after consistent study and trial, has succeeded to develop a novel toothpaste squeezer which can completely get rid of these disadvantages, the invention will now be disclosed as follows.

SUMMARY OF THE INVENTION

It is an object of the present invention to provide a novel toothpaste squeezer which can supply a fixed quantity of toothpaste on the surface of a toothbrush without allowing the toothpaste container to contact the toothbrush, only with a slight squeezing force thereby preventing infectious contamination which might occur due to mutual contact between toothbrush and toothpaste container, and also preventing too much consumption of toothpaste and too frequent open/close operation as a conventional commonly used toothpaste tube commits.

In order to achieve the above mentioned object, the novel toothpaste squeezer of the present invention comprises: a corrugated elastic tube with its two ends connected to a delivery tube and a guide tube respectively; a delivery tube having a supply head at its front end whose opening side being straightly extended downwards, a slider is provided at the bottom of the delivery tube which being coupled with a sliding guide installed on a base plate, a toothbrush seat is located at the front end of the slider for placing a toothbrush thereon and moving the slider and the delivery tube to and fro along the sliding guide; a guide tube composed for a right angle joint and a bushing interposed with a check valve therebetween, the inner edge of the bushing is threaded with screw threads to engage a toothpaste container with the guide tube either by screwing or direct insertion; and a base plate composed of a sliding guide and a fender, the sliding guide is for the slider provided at the bottom of the delivery tube to slide thereon, whereas the fender is fastened with the delivery tube.

By means of the toothpaste squeezer constructed as such, when the toothbrush placed on the toothbrush seat moves the slider and the delivery tube to and fro along the sliding guide thereby squeezing and releasing the corrugated elastic tube to absorb the toothpaste from the toothpaste container to output and then interrupt outputting the toothpaste from the supply head of the delivery tube resulting in supplying a fixed quantity of toothpaste to the toothbrush without making mutual contact between the supply head and the toothbrush to prevent possible contamination. The appearance of the delivery tube is made into a pleasant looking human, bird or animal head figures.

BRIEF DESCRIPTION OF THE DRAWINGS

The drawing disclose an illustrative embodiment of the present invention which serves to exemplify the various advantages and objects hereof, and are as follows.

DETAILED DESCRIPTION OF THE PREFERRED EMBODIMENT

Figure 1:
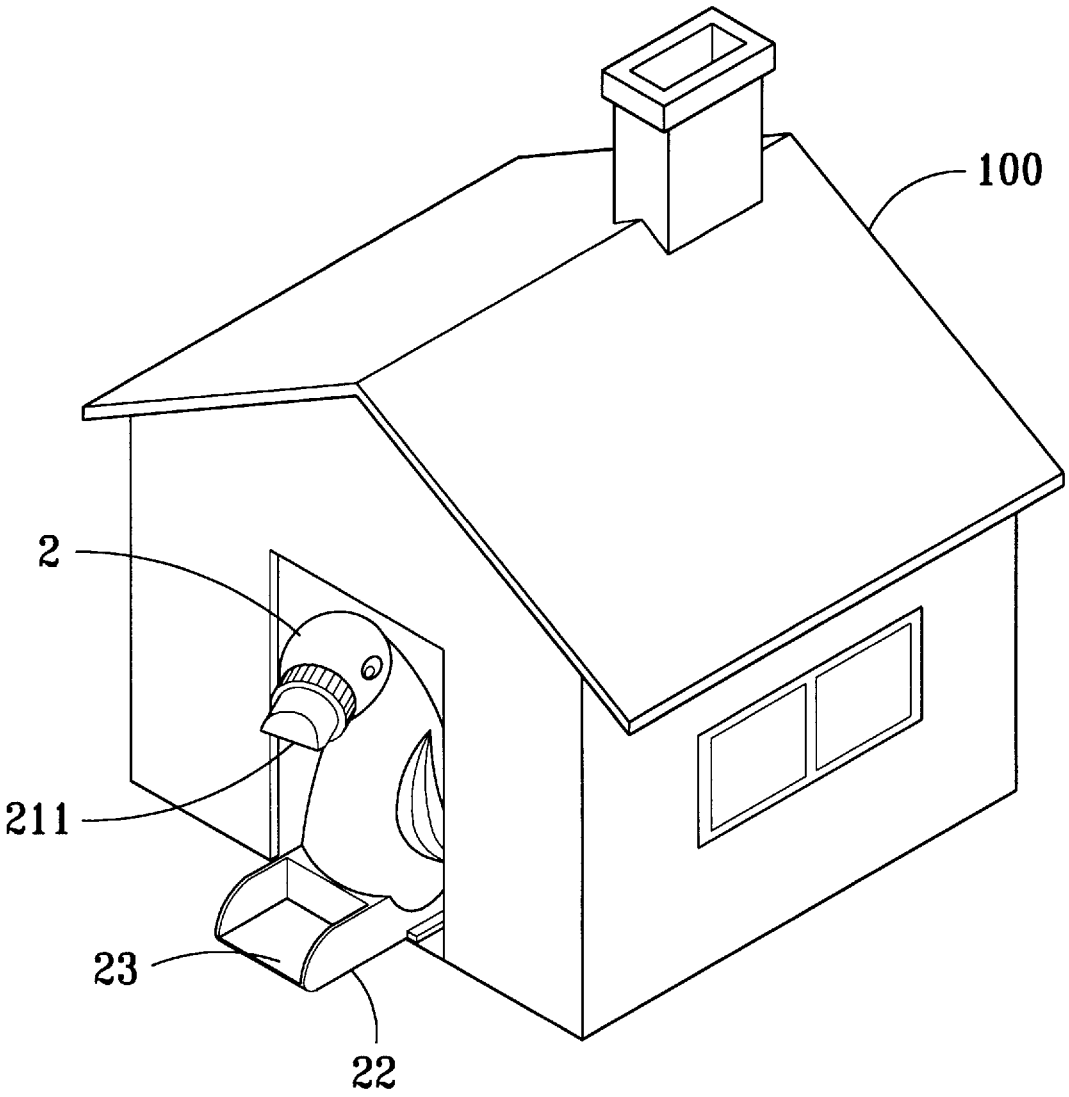
FIG. 1 is a three dimensional drawing showing the outer appearance of the novel toothpaste squeezer according to the present invention.
Figure 2:
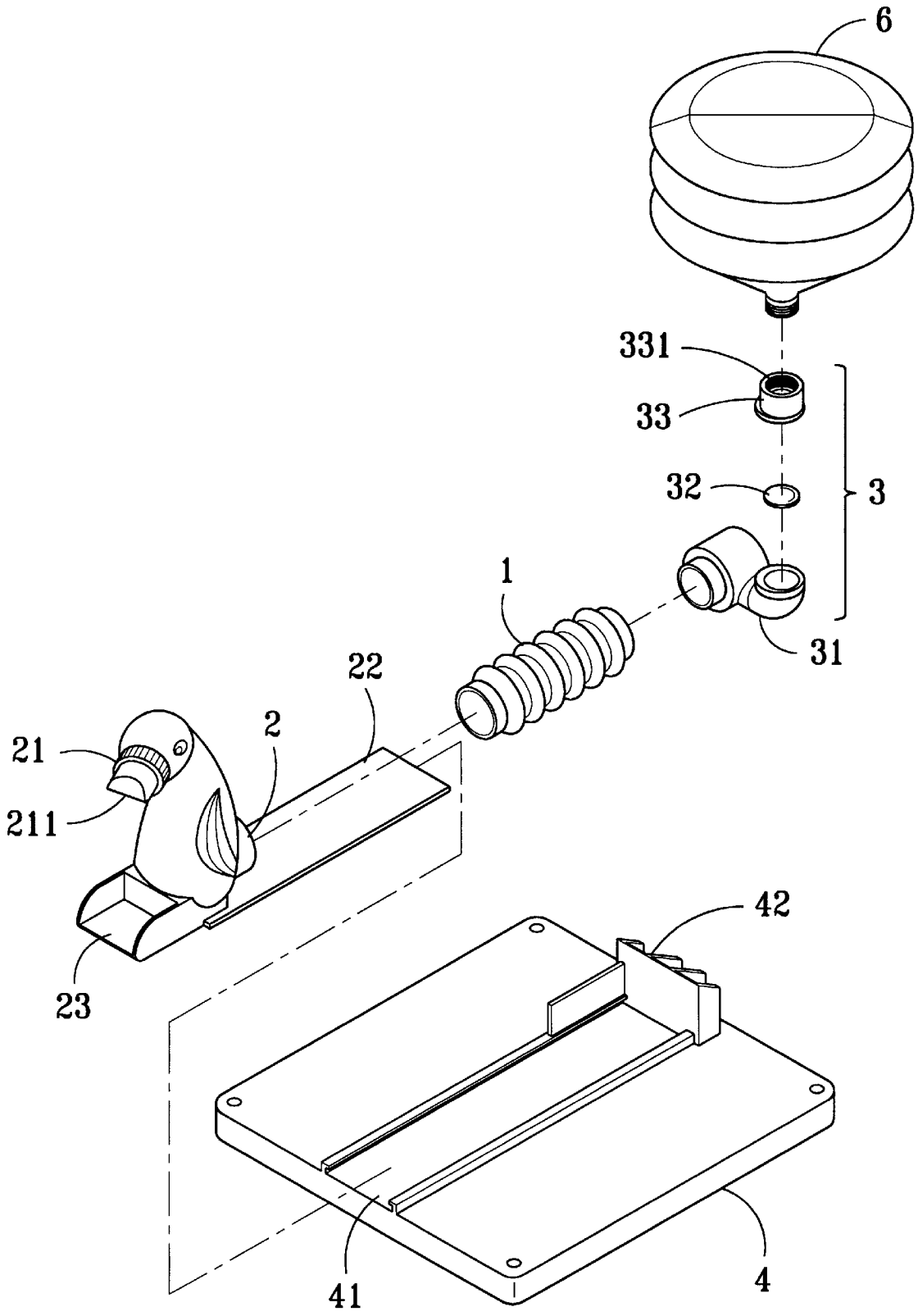
FIG. 2 is a drawing showning the exploded three dimensional drawing of the novel toothpaste squeezer according to the present invention.

Referring to FIGS. 1 and 2, the novel paste squeezer of the present invention comprises a corrugated elastic tube 1 with its two ends connected to a delivery tube 2 and a guide tube 3 respectively. The delivery tube 2 is bent in ∩ shape with a supply head 21 having an appearance of 45°~90° tilted figure of human or animal mouth or bird beak at its front end, the opening side of the supply head 21 is straightly extended downwards, and a slider 22 is provided at the bottom of the delivery tube 2 which is coupled with a sliding guide 41 installed on a base plate 4 to move to and fro guided by sliding guide on the base plate 4. Here, the outer appearance of the delivery tube 2 is made into a pleasant looking human, bird or animal figures. The guide tube 3 is composed of a right angle joint 31 and a bushing 33 interposed with a check valve 32 therebetween. The inner edge of the bushing 33 is threaded with screw threads 311 to engage a toothpaste container 6 with the guide tube 3 either by screwing or direct insertion. A base plate 4 comprises the sliding guide 41 and fender 42, the delivery tube 2 is fastened to the fender 42. After being assembled, the above assembly is accommodated in an ornamental case 100 of human, animal or other figures, or directly fastened to a proper location in the washing room.

Figure 3A:
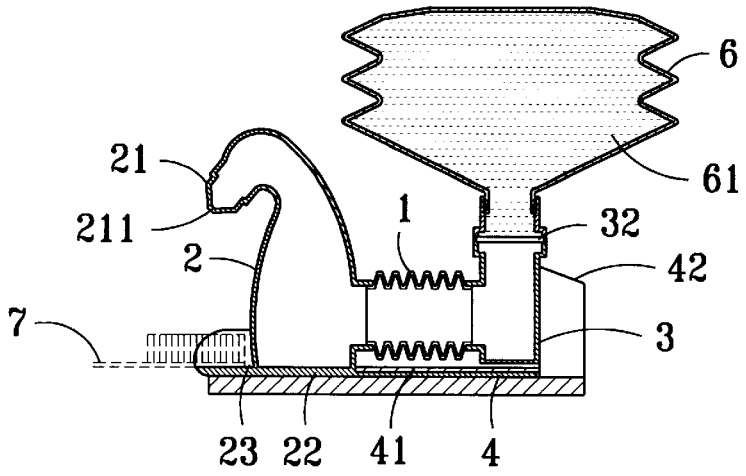
FIGS. 3A through 3C are drawings illustrating the sequential action of the novel toothpaste squeezer according to the present invention.
Figure 3B:
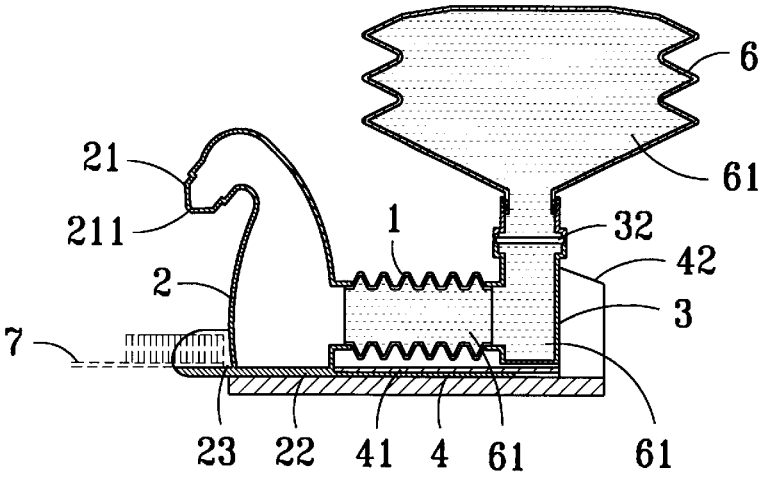
Figure 3C:
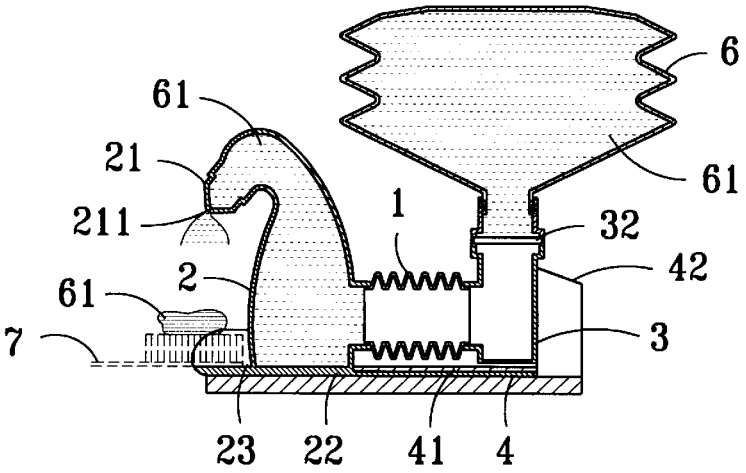

Referring to FIGS. 3A through 3C, when using the toothpaste squeezer of the present invention, at first place a toothbrush 7 on the toothbrush seat 23 in front of the slider 22 and push the toothbrush 7 towards delivery tube 2 to drive the slider 22 thereunder inwardly displacing along the sliding guide 41 on the base plate 4 thereby compressing the corrugated elastic tube 1 (See FIG. 3A), and then releasing it so as to enable it to restore and absorb a fixed quantity of toothpaste 61 from the toothpaste container 6 to store therein (See FIG. 3B), then afterwards, pushing the toothbrush 7 towards the delivery tube 2 again thereby compressing the corrugated elastic tube 1, at this time the toothpaste 61 which being formerly stored in the corrugated elastic tube 1 is squeezed out via supply head 21 and automatically drops on the surface of the toothbrush 7 ( See FIG. 3C). The function of supplying the toothpaste 61 with a fixed amount is carried out by closure of the opening of the straight supply head 21 during squeezing and releasing the corrugated elastic tube 1. After withdraw of toothbrush 7, the corrugated elastic tube 1 once more absorbs the toothpaste 61 from the toothpaste container 6 and stores therein preparing for service in the next time. The check valve 31 provided in the guide tube 3 serves to prevent invasion of air into the toothpaste container 6 so as to ensure smooth delivery of toothpaste 61 from the toothpaste container 6.

The toothpaste squeezer provided by the present invention has the advantages of supplying a fixed quantity of toothpaste to the toothbrush without allowing mutual contact between the toothpaste container and the toothbrush which contributes to prevent infectious contamination, and too much consumption of toothpaste, and also to save too frequent open/close operation as a conventional commonly used toothpaste tube commits.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A novel toothpaste squeezer comprises:

a corrugated elastic tube with its two ends connected to a delivery tube and a guide tube respectively;

a delivery tube having a supply head at its front end whose opening side being straightly extended downwards, a slider being provided at the bottom of said delivery tube which being coupled with a sliding guide installed on a base plate, a toothbrush seat being located at the front end of the slider for placing a toothbrush thereon and moving the slider and said delivery tube to and fro along the sliding guide;

a guide tube composed of a right angle joint and a bushing interposed with a check valve therebetween, the inner edge of the bushing being threaded with screw threads to engage a toothpaste container with said guide tube by screw combination; and a base plate composed of a sliding guide and a fender, said sliding guide is for said slider provided at the bottom of said delivery tube to slide thereon, whereas said delivery tube is fastened to said fender;

by means of said toothpaste squeezer constructed as such, when the toothbrush placed on the toothbrush seat moves said slider and said delivery tube to and fro along said sliding guide thereby squeezing and releasing said corrugated elastic tube to absorb the toothpaste from a toothpaste container to output and then interrupt outputting the toothpaste from the supply head of said delivery tube resulting in supplying a fixed quantity of toothpaste on the toothbrush without making mutual contact between the supply head and the toothbrush to prevent possible contamination.

2. The toothpaste squeezer as claimed in claim 1, wherein a check valve is installed in said guide tube for preventing invasion of air into said toothpaste container during squeezing and releasing said corrugated elastic tube.

3. The toothpaste squeezer as claimed in claim 1, wherein said toothpaste container is formed into an envelope which can tightly enclose the toothpaste therein.

4. The toothpaste squeezer as claimed in claim 3, wherein said toothpaste continer can be directly inserted to said guide tube.

* * * * *